United States Patent [19]

Ljung

[11] 4,182,130

[45] Jan. 8, 1980

[54] METHOD AND APPARATUS FOR DEFROSTING A DISPLAY REFRIGERATOR OR FREEZER

[75] Inventor: Hans G. Ljung, Bjärred, Sweden

[73] Assignee: Aktiebolaget Electrolux, Stockholm, Sweden

[21] Appl. No.: 878,301

[22] Filed: Feb. 16, 1978

[30] Foreign Application Priority Data

Feb. 16, 1977 [SE] Sweden ..... 7701713

[51] Int. Cl.[2] ..... F25D 21/12

[52] U.S. Cl. ..... 62/82; 62/256

[58] Field of Search ..... 62/256, 82, 282

[56] References Cited

U.S. PATENT DOCUMENTS

| | | | |
|---|---|---|---|
| 2,822,672 | 2/1958 | Dickson et al. | 62/256 X |
| 2,929,227 | 3/1960 | Rainwater | 62/256 |
| 2,960,844 | 11/1960 | Quick | 62/256 X |
| 3,226,945 | 1/1966 | Spencer | 62/256 |
| 3,424,233 | 1/1969 | Meckler | 236/13 |
| 3,593,538 | 7/1971 | Bachman et al. | 62/256 |

FOREIGN PATENT DOCUMENTS 44010 4/1971 Finland .

*Primary Examiner*—William F. O'Dea
*Assistant Examiner*—William E. Tapolcai, Jr.
*Attorney, Agent, or Firm*—Alfred E. Miller

[57] ABSTRACT

The method and apparatus relates to defrosting cooling elements in an open type display cooler or freezer cabinet. The method involves circulating air over cooling elements and over the open display cabinet top having articles therein that are cooled or frozen. The air, during circulation, is taken into a channel along a side edge of the stored articles, and a guide member assumes another position other than its normal position during defrosting.

9 Claims, 9 Drawing Figures

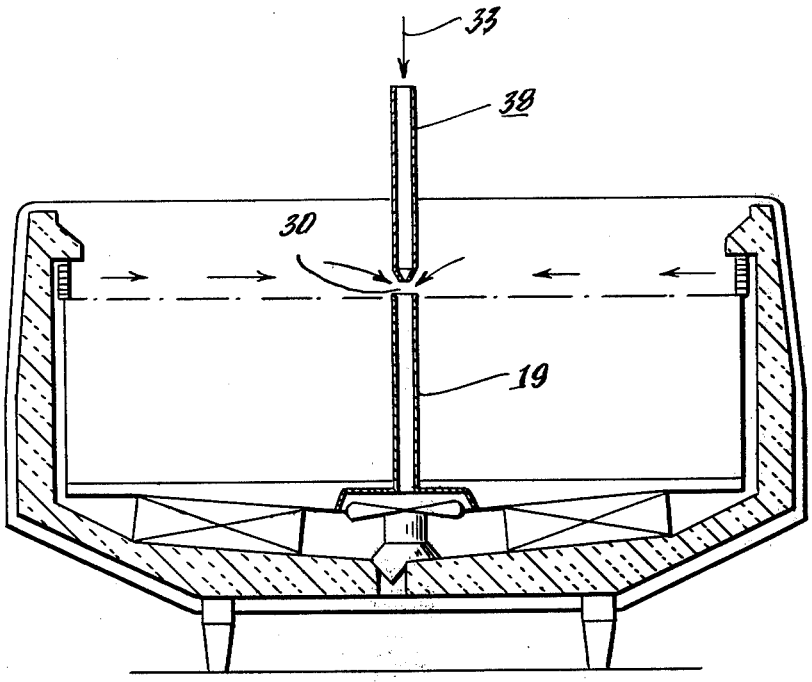
Fig. 5.
Fig. 6.
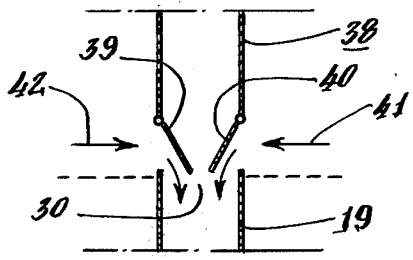
Fig. 7.
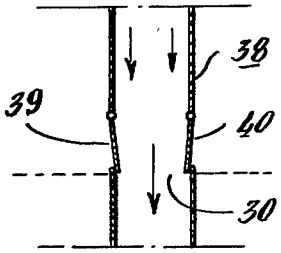
Fig. 8.
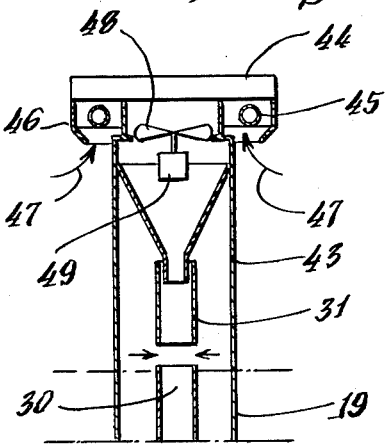
Fig. 9.
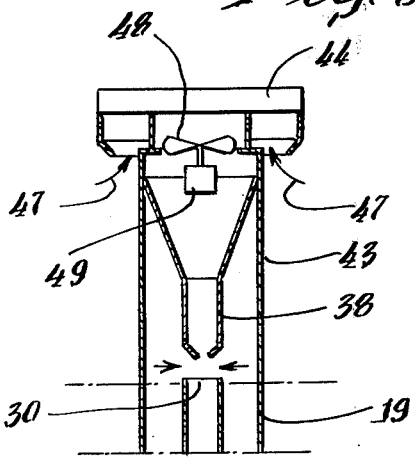

METHOD AND APPARATUS FOR DEFROSTING A DISPLAY REFRIGERATOR OR FREEZER

BACKGROUND OF THE INVENTION

Display type cooler or freezer chests are known in which air is circulated in order to cool the articles therein. In this type of chest a very small quantity of the cooled air flows out of the circulation path at the open side thereof. This quantity of cooled air is replaced by warm atmospheric air which is drawn into the circulating channel in the chest and deposits its contents of moisture. This moisture, unfortunately, will successively settle in the form of frost on the cooling elements in the channel. Thus, it is necessary to defrost the cooling elements at regular intervals in order to maintain the cooling efficiencies of the elements of the display chest. For the foregoing purpose, it is known to provide electric elements which are placed alongside the cooling elements. Thereafter, the cooling compressor is shut off and heat is applied to the electrical elements. Simultaneously, fans are operated so that the circulation of air continues. This method results in a relatively rapid defrosting of the elements. However, a substantial increase in the electrical input rate is the result, and an expensive assembly of electric elements with connecting wires are required. Therefore, in order to avoid the disadvantages of the foregoing method, it has been proposed to use heat from the atmosphere circulating about the chest. Thus, display cooler and freezer chests have been made with special air channels through the walls for supplying warm atmospheric air and removing the cold air which, during defrosting, is cooled by the cooling elements. As a result, there will be no longer a circulating quantity of air in a display cooler or freezer chest. However, this method is more complicated because, in addition to the extra air channels, a system of movable flaps is required. These movable flaps must be reset before and after defrosting so that the desired air paths are obtained. In addition, the foregoing method has another disadvantage in that the defrosting means involves an increased cost for a display cooler and freezer chest, and further that they are an additional source of operational disturbance. Consequently, the latter method also entails increased requirements for supervision of the defrosting procedure. A prior art construction is shown in Finnish Patent Application No. 1314/70 filed May 11, 1970 and published on Apr. 30, 1971, and issued as Finnish Pat. No. 44010, in which an air channel for warm air is shown directing the latter to a cooled air channel.

In order to avoid the drawbacks of the known methods of defrosting a display cooler or freezer it is a principal feature of the present invention to provide defrosting of a display cooler or freezer by a simple and reliable means without any significant increase of ost, as well as of the rated electrical input. In order to achieve the foregoing improvement the invention is generally characterized in that an intake for the circulating air is blocked and warm atmospheric air is directed from a place outside of the circulation path to the intake in order to be conveyed by fans through the cooling elements in the channel and out to the atmosphere through the normal outlet opening.

A further feature of the present invention is that the guide member during defrosting forms an intake for air to the channel from a location having warm atmospheric air outside of the circulation path, with the channel for the rest of the air being unchanged so that the air is discharged through the normal outlet opening.

In order that the invention will be more clearly understood, it will now be disclosed in greater detail with reference to the accompanying drawings, in which:

FIG. 5 is a vertical section of another embodiment of the invention, but similar to that shown in FIG. 3;

FIGS. 6 and 7 show enlarged details in section of the chest, with positions of the relative details during normal operation and during defrosting; respectively and FIGS. 8 and 9 show two other embodiments of details used in the defrosting cycle of the present invention.

DESCRIPTION OF THE PREFERRED EMBODIMENTS

Figure 1:
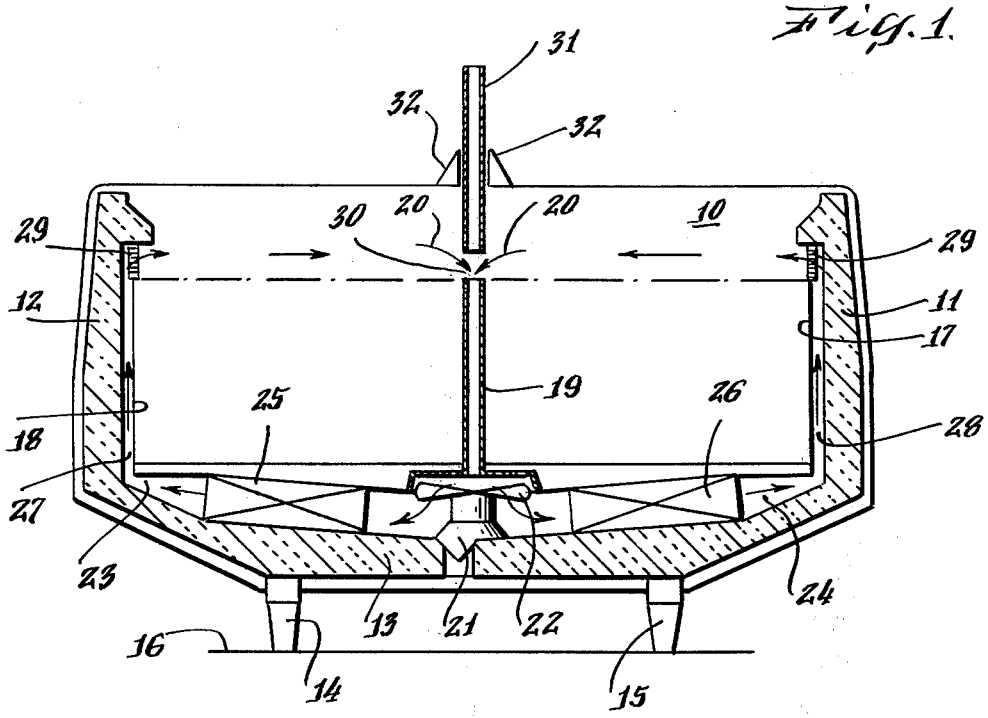
FIG. 1 is a vertical cross-section through a display cooler or freezer chest shown during normal operation.

Referring particularly to FIG. 1, a display cooler or freezer is shown having two short sides 10. Only one of such short sides is shown for purposes of clarity. The two long sides of the display chest 11 and 12, respectively, are so constructed as to make the chest accessible for customers from both sides and the contents can be viewed from above through the open top. The display chest also is provided with a bottom 13 that has feet 14 and 15 which are positioned to rest on a floor 16. It will also be noted that the display chest has two separate boxes 17 and 18 for storing articles therein, and between these boxes, the display chest has a vertical air channel 19. It will be observed that during normal operation of the present display cooler or freezer, air is drawn in, as illustrated by the arrows 20, in the upper part of the central channel 19 and downwardly to the fans 22, which are operated by motors 21. The fans move the air through a continuous channel 23 to the left and a continuous channel 24 to the right. As shown in FIG. 1, in the channel 23 air passes through a cooling element 25, whereas in the channel 24 it passes through another cooling element 26. The air then rises through vertical channel portions 27 and 28 at opposite sides of the display chest to be blown in a horizontal direction through opposite guides 29 at each side of the chest to the center thereof where it is again drawn into the chest, as shown by the arrows 20. It should be noted that the air circulates through a common central channel 19, and then splits into two circulation paths and finally comes together to cover the open top of the store of articles in the display cooler or freezer. The cooling elements 25 and 26 can be pipe coils with fins, and may be connected to a cooling apparatus of a known type which circulates refrigerants through said coils.

The display chest is provided with a guide tube or air channel section 31 located above the intake opening 30 to the vertical central channel 19 of the display chest. The guide tube 31 is capable of moving upward and downward between spaced abutments 32 located at the short sides 10 of the display chest and/or by other guide means (not shown), as arranged on the display chest. The spaced abutments 32 may also serve as a support for maintaining the guide 31 in the position shown in FIG. 1, in which the lower part of the guide 31 is located at a distance from the intake opening 30, so that the air circulation is not disturbed by the guide 31.

Figure 2:
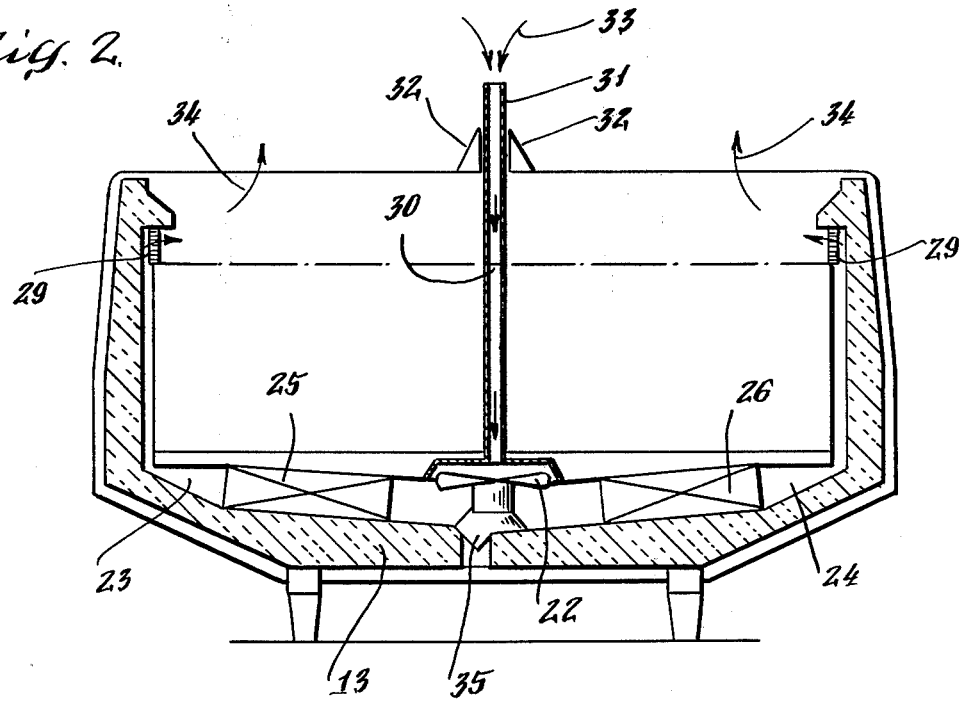
FIG. 2 is a vertical section showing the same chest during defrosting.

Referring now to FIG. 2, it will be seen that when the display chest is to be defrosted, the guide tube 31 is moved downwardly to abut the intake opening 30 of the central channel 19, so that the guide tube 31 and the central channel 9 are coaxial. Thus, it should be evident that no circulating air will be drawn into the location between the guide tube 31 and the channel 19. However, warm atmospheric air is instead taken through guide tube 31 and channel 19 to the fans 22, as indicated by the arrows 33 in FIG. 2. Moreover, the fans 22 force the intake air through the cooling elements 25 and 26 in different directions and through the channels 27 and 28, and thereafter through the guides 29 on opposite sides of the display chest and over the open top of the display chest. Since no air is drawn in at the center line of the chest above the channel 19, the air will flow out into the atmosphere at either side of the chest as shown by the arrows 34 (FIG. 2). It will be recognized that because of the present method that, during defrosting, the fans operate with a continuous supply of warm air so that the cooling elements 25 and 26 are completely defrosted. The water that thaws is thus collected on the inner surface of the bottom 13 of the chest. It will be observed that the bottom 13 is inclined so that the water will flow to a discharge conduit 35 and thereafter to a drain (not shown).

Figure 3:
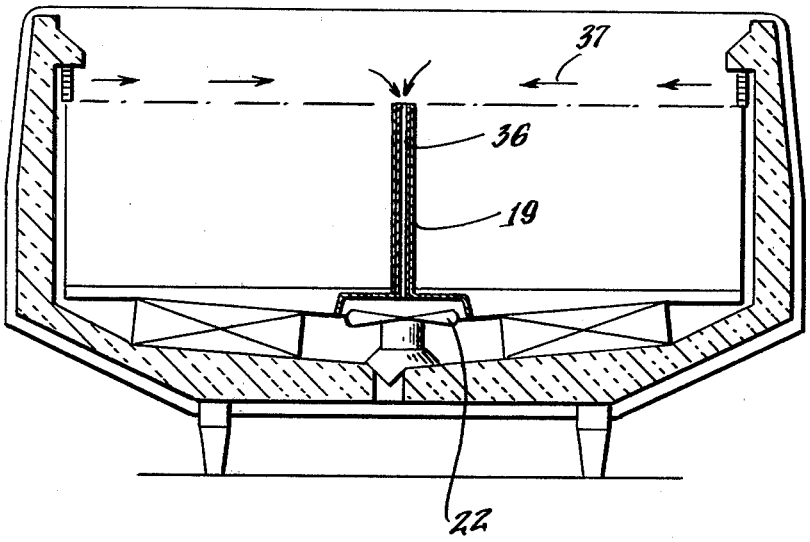
FIGS. 3 and 4 are vertical sections showing a modified embodiment of the chest shown in FIGS. 1 and 2, and illustrated during normal operation in FIG. 3 and defrosting in FIG. 4.
Figure 4:
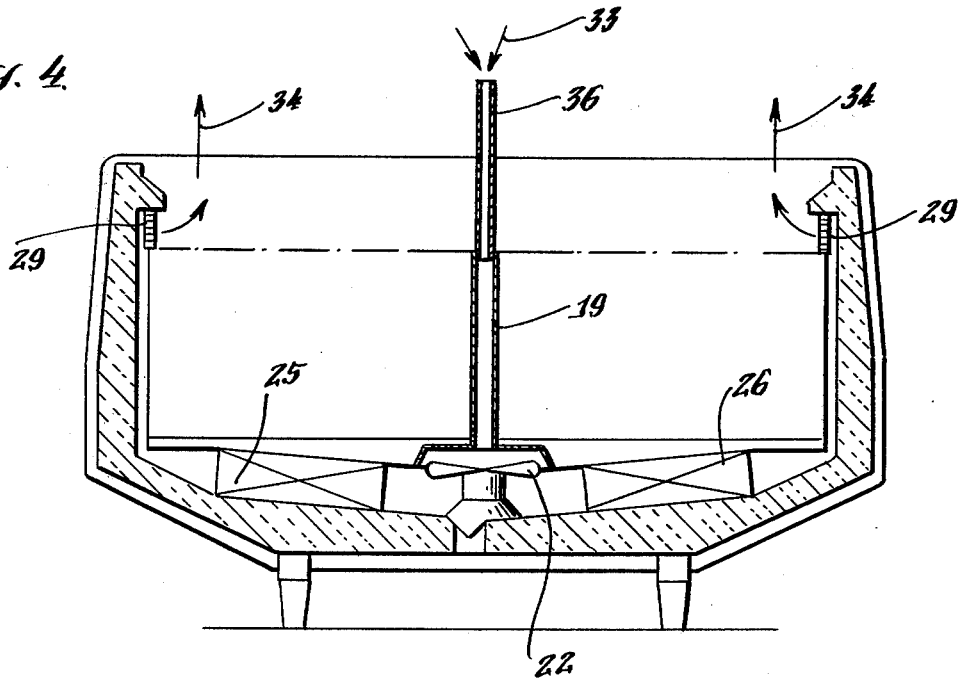

Referring now to FIGS. 3 and 4, a display cooler or freezer of the type similar to that shown in FIGS. 1 and 2, is illustrated. However, shown therein is an air guide 36 which is movable upwardly and downwardly and is disposed concentrically within the vertical central channel 19 of the display chest. As seen in FIG. 3, the display chest is in a normal cooling operation phase with the guide 36 disposed within the central channel 19 and the air driven by the fans 22 caused to circulate in two separate paths, in the same manner as described in connection with FIG. 1 and also illustrated by the arrows 37 in FIG. 3. In this embodiment, when the display chest is to be defrosted, the guide 36 is moved upwardly to a position as shown in FIG. 4, so as to prevent air above the store of articles within the display chest from entering the intake opening 30. Instead, a connection is established to a location at which warm atmospheric air is taken into the display chest, as shown by the arrows 33. Consequently, the cold air which has been forced into the air channels and through the cooling elements 25 and 26 by means of the fans 22 is blown through the guides 29 along a side edge at each side of the display chest housing articles therein. This air, however, will no longer flow to the intake opening 30 but will dissipate into the atmosphere, as indicated by the arrows 34 in FIG. 4.

FIG. 5 shows another embodiment of the display cooler or freezer having a defrosting means of a different design. In this connection it should be noted that the guide 38 is disposed over the air intake 30 and, as shown on an enlarged scale in FIG. 6, the guide 38, at its lower end situated over the opening of the air intake 30, is provided with movable flaps 39 and 40. The flaps are shown in FIG. 6 in their positions during normal operation when air is circulating, as shown by the arrows 41 and 42. In this position air is taken out of the circulation path from the sides of the intake opening 30. The same details as shown in FIG. 6 are also shown in FIG. 7, but the flaps 39 and 40 are illustrated in another position whereby they block the path of circulating air to the intake opening 30. In this position, warm air from the atmosphere passes through the guide 38, as shown by the arrows 33 in FIG. 5.

Referring now to FIG. 8, a section of the vertical central channel 19, is shown in a display cooler or freezer with means disposed above this channel for defrosting the cooling elements in the air channels of the display chest. The latter is provided with a frame 43 supporting a display shelf 44 located above, for items which are not cooled. It will be observed that at the underside of the shelf 44, elongated illuminating means 45 are provided, as well as metal plates 46, which screens said illuminating means. Openings are provided under the illuminating means 45 which serve as intakes for warm atmospheric air and which further are heated by the illuminating means 45. The incoming air is shown by the arrows 47 and during the defrosting cycle the air is drawn in under the shelf by means of fans 48 driven by motors 49. The fans force the air downwardly into the guide 31 whose design corresponds to the one shown in FIGS. 1 and 2, that is, it is movable upwardly and downwardly in a coaxial manner. In FIG. 8, the guide 38 is shown in a normal cooling position when circulating air is taken in through the intake opening 30 to the channel 19. However, during defrosting, the guide 31 is moved downwardly as described in connection with the structure shown in FIG. 2, and covers the intake opening 30. Simultaneously, the fans 48 become operative and thereby it is possible during defrosting to work with large quantities of relatively warm air in the respective channels.

The apparatus shown in FIG. 9 also is provided with an extra shelf 44 for items that are not to be cooled and a fan 48 driven by a motor 49. It should be observed that the guide 38 is provided with flaps 39 and 40 arranged in the same manner as the structure shown in FIGS. 5–7.

Inasmuch as the temperature of the warm atmospheric air is considerably higher than that of the cooling elements 25 and 26, but has limited heat content, it can be used for defrosting, but it is not sufficient for a rapid defrosting procedure. Therefore, the apparatus constructed in accordance with the invention permits a quantity of air to be conveyed per unit of time on defrosting which can be larger than the quantity of air circulated during normal operation. It is also suitable to make the device such that the quantity of air circulated in the display chest is 2 to 4 times larger on defrosting than the air circulated during normal operation. A large quantity of air can be obtained by changing the speed of the fans, for example by means of a transformer or a thyristor control. For example, this speed changing means can be connected in the electrical circuit to the fan motors, so that a voltage reduction is achieved, whereby the fans are operated at a high speed during defrosting, and a lower speed during normal operation.

It is desired not to limit the present invention to the embodiment shown or described, but it should be apparent that many modifications can be utilized within the scope and concept of the following claims of the invention. In the figures of the drawings as well as the above description thereto, display chests and their air guides only have been discussed, but no special means for providing the movement of the guides or for keeping them in one position or another is shown. In this regard the guide members of FIGS. 1 to 4, and 8 can be made to be operated manually and in that case hooks, or the like, are provided in which the guides can be secured in an upper position during defrosting. However, it is desirable to have the foregoing adjustment performed automatically and depending, for example on a timer, which has the capability of disconnecting the cooling action of the cooling elements. Thus, for this purpose levers, pistons or toothed segments and an electric motor, for example a so-called damper motor, plus levers can be used so that a parallel movement is obtained.

What is claimed is:

1. A method of defrosting cooling elements in an open-top display cooler or freezer chest having at least one fan that circulates air through a channel in said chest having cooling elements therein, and along the top of said chest, said channel having a substantially vertical air channel, said chest having articles stored therein comprising: circulating air in a channel along a side edge of said stored articles, providing a warm air guide channel for circulating air which upon defrosting assumes a position other than its normal position, said other position being such that an intake for said circulating air is blocked and warm atmospheric air is brought in from a place outside of the normal circulation path to said intake for being conveyed by said fan through said cooling elements in said channel and out to the atmosphere through said normal outlet opening, and upon defrosting said warm air guide channel assumes said other position when moved coaxially relative to the free end of said vertical air channel to thereby abut the latter in a position in alignment therewith.

2. The method as claimed in claim 1 wherein the quantity of air per unit time conveyed in said channel during defrosting is at least twice as large as the quantity conveyed during normal operation.

3. The method as claimed in claim 1 further comprising adjusting said fans in said air channel to make the quantity of air conveyed in said channel during defrosting at least twice as large as the quantity of air conveyed during normal operation.

4. The method as claimed in claim 1 wherein additional heat is supplied to said vertical air channel by causing the air taken into the channel to pass adjacent to an illuminating device which also delivers heat to the air.

5. Apparatus for defrosting cooling elements in an open-top display cooler or freezer chest comprising an air channel in said chest, said air channel being provided with a substantially vertical centrally located channel therein, at least one fan to circulate air in an air circulation path through a normal outlet opening and over stored articles in said chest, said air flow circulating through cooling elements in said channel and over the open-top of said chest, and a warm air guide channel movable relatively to said vertical air channel wherein said guide channel during defrosting forms an intake for air to said vertical air channel from a location having warm atmospheric air outside said air circulation path, the part of the channel for the remainder of the air being unchanged whereby air is discharged through said normal outlet opening.

6. Apparatus as claimed in claim 5 wherein said warm air guide channel is movable from one position during normal operation in which it is located at the side of said circulation path to a position during defrosting in which it covers the normal intake to said channel and connects said channel to a location outside said chest.

7. Apparatus as claimed in claim 5 wherein said guide channel is provided with parts that are adjustable to two positions of which one is for normal operation for directing the circulating air to said air intake and the other position for defrosting in which said parts block the air intake for circulating air and form a connection to a location at which atmospheric air is drawn into said vertical channel.

8. Apparatus as claimed in claim 5 wherein means are provided for said fans so that during defrosting a quantity of air per unit time conveyed through said vertical channel is at least twice as large as the quantity of air conveyed through said vertical channel during normal operation.

9. Apparatus as claimed in claim 7 wherein additional fans are arranged in the intake to said vertical channel.

* * * * *